US009468969B2

(12) United States Patent
Focken et al.

(10) Patent No.: US 9,468,969 B2
(45) Date of Patent: Oct. 18, 2016

(54) AXIAL THREAD ROLLING HEAD AND METHOD FOR FORMING AN EXTERNAL THREAD ON A WORKPIECE WITH AN AXIAL THREAD ROLLING HEAD

(71) Applicant: LMT Fette Werkzeugtechnik GmbH & Co. KG, Schwarzenbek (DE)

(72) Inventors: Andreas Focken, Schwarzenbek (DE); Frank Smidt, Tramm (DE)

(73) Assignee: LMT FETTE WERKZEUGTECNIK GMBH & CO. KG, Schwarzenbek (DE)

( * ) Notice: Subject to any disclaimer, the term of this patent is extended or adjusted under 35 U.S.C. 154(b) by 110 days.

(21) Appl. No.: 14/256,453

(22) Filed: Apr. 18, 2014

(65) Prior Publication Data

US 2014/0311202 A1 Oct. 23, 2014

(30) Foreign Application Priority Data

Apr. 19, 2013 (EP) ..... 13002074

(51) Int. Cl.
*B21H 3/04* (2006.01)

(52) U.S. Cl.
CPC ..... *B21H 3/044* (2013.01)

(58) Field of Classification Search
CPC ..... B21H 3/02; B21H 3/022; B21H 3/025; B21H 3/04; B21H 3/042; B21H 3/044; B21H 3/046; B21H 9/02; B21B 19/16
See application file for complete search history.

(56) References Cited

U.S. PATENT DOCUMENTS

| | | | | |
|---|---|---|---|---|
| 2,720,801 | A * | 10/1955 | Erdelyi | B21H 3/046 408/151 |
| 4,050,276 | A * | 9/1977 | Habegger | B21H 3/042 72/104 |
| 4,096,722 | A * | 6/1978 | Torralba | B21H 3/042 470/84 |
| 2008/0010807 | A1 * | 1/2008 | Fujii | B21H 3/04 29/558 |

FOREIGN PATENT DOCUMENTS

| | | |
|---|---|---|
| CN | 389 550 | 7/1965 |
| EP | 0552713 | 7/1993 |
| GB | 567700 | 2/1945 |

* cited by examiner

*Primary Examiner* — Debra Sullivan
(74) *Attorney, Agent, or Firm* — Vidas Arrett & Steinkraus

(57) ABSTRACT

The invention relates to an axial thread rolling head, comprising a head part, in which at least three thread rolls are rotatably mounted, wherein the thread rolls among themselves border an insertion section for a workpiece and wherein the thread rolls each have a profile for forming an outer thread on the workpiece, wherein the thread rolls are held non-adjustably in the radial direction in the head part, wherein the profile of the thread rolls is respectively designed asymmetrically such that the thread rolls with their asymmetrical profile form a symmetrical external thread on the workpiece. The invention also relates to a corresponding method.

17 Claims, 3 Drawing Sheets

Figure 1:
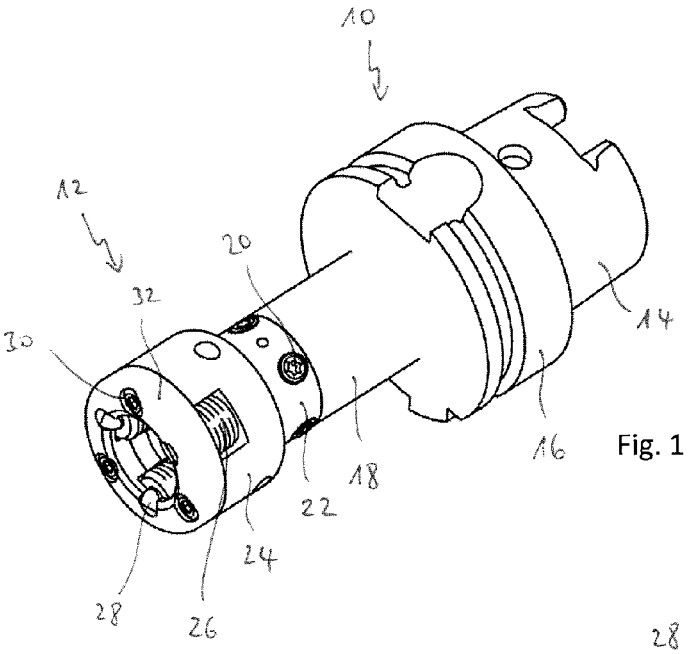

AXIAL THREAD ROLLING HEAD AND METHOD FOR FORMING AN EXTERNAL THREAD ON A WORKPIECE WITH AN AXIAL THREAD ROLLING HEAD

CROSS-REFERENCE TO RELATED APPLICATIONS

This application claims priority to EP Application No. 13 002 074.6, filed on Apr. 19, 2013, the entire contents of which is incorporated herein by reference.

BACKGROUND OF THE INVENTION

The invention relates to an axial thread rolling head, comprising a head part, in which at least three thread rolls are rotatably mounted, wherein the thread rolls amongst themselves border an insertion section for a workpiece and wherein the thread rolls each have a profile for forming an outer thread on the workpiece. The invention further relates to a method for forming an external thread on a workpiece with an axial thread rolling head.

With such axial thread rolling heads, external threads are created on generally cylindrical workpieces through cold forming. The thread rolls have a profile on their circumference for the forming of the external thread. The workpiece is inserted into the insertion section of the axial thread rolling head during the course of a relative movement between the axial thread rolling head and the workpiece, wherein the external thread is created by the profile of the thread rolls. Axial thread rolling heads are known, in which after complete formation of the external thread on the workpiece, in particular a complete insertion of the workpiece into the insertion section of the axial thread rolling head, the axial thread rolling head is opened by an mechanical actuation mechanism. The thread rolls are thereby moved outward in the radial direction and the axial thread rolling head can be pulled off the workpiece without the thread rolls colliding, i.e. engaging, with the workpiece. This results in a simple processing with precisely produced external threads.

However, disadvantageous thereby is a comparatively large space requirement for the radial movement of the thread roller bearing including the thread rolls arranged on it in the working space of the processing machine. This working space must naturally also include the workpiece contour. Moreover, a not insignificant installation space is required for the actuation mechanism for radial adjustment of the thread rolls outwards in the axial thread rolling head itself. Due to the increasingly desired component size reduction, for example in the automotive industry, the space available for processing is becoming increasingly smaller. One example is the production of external threads on cylindrical appendages of fuel injection rails of an automobile. Pressure lines can be connected to the formed external threads. Among other things due to the enormous operating pressures, there are very high requirements for the accuracy and thus impermeability of the produced threads. A rolling die for the pressing of threads is known from EP 0 552 713 A1, which is non-opening. The advantage is that this rolling die is built comparatively small and requires no space for opening. However, in the case of the known rolling die, a considerable deflection of the thread rolls results during the course of the processing, among other things because the rolling die does not have a head plate and the thread rolls are thus little reinforced against deflection due to the small size of the rolling die. This deflection leads to process errors on the workpiece. In particular, the external thread produced on the workpiece does not always have the provided profile.

The deflection can be reduced to a limited scope through the provision of a head plate. A deflection of the thread rolls can also be compensated to a certain degree through a skewing of the axles of the thread rolls with respect to the longitudinal axis of the insertion section. However, support measures for preventing a deflection of the thread rolls can naturally only be taken in a limited and constructive manner in the case of the specified diameter of the thread to be produced on the workpiece on one hand and the maximum cross-section of the axial thread rolling head on the other hand. In particular in the case of the processing of high-strength materials with tensile strengths e.g. of more than 1,000 N/mm$^2$, a deflection of the thread rolls cannot be completely prevented through constructive measures.

Based on the named state of the art, the object of the invention is thus to provide an axial thread rolling head and a method of the initially named type, with which comparatively large diameters in the case of small outer dimensions of the axial thread rolling head can be produced reliably and precisely in the specified manner.

The invention solves this object through the subjects of claims 1 and 16. Advantageous embodiments are found in the dependent claims, the description and the figures.

The invention solves the object for one through an axial thread rolling head, comprising a head part, in which at least three thread rolls are rotatably mounted, wherein the thread rolls amongst themselves border an insertion section for a workpiece and wherein the thread rolls each have a profile for forming an outer thread on the workpiece, wherein the thread rolls are held non-adjustably in the radial direction in the head part and wherein the profile of the thread rolls is respectively designed asymmetrically such that the thread rolls with their asymmetrical profile form a symmetrical external thread on the workpiece. The axial thread rolling head can also comprise a shaft, which holds the head part.

The basic function of the axial thread rolling head is similar to that described above for the state of the art. The thread rolls, also called profile rolls, of the axial thread rolling thread according to the invention thus border in a generally known manner amongst themselves an insertion section for example for a cylindrical workpiece to be processed. Through a suitable relative movement between the axial thread rolling head and the workpiece, the workpiece is inserted into the insertion section, wherein the cross-section of the workpiece is large enough that the profile of the thread rolls engages in the outer surface of the workpiece and an external thread is created in the workpiece through cold deformation. For this, the thread rolls have in the generally known manner a profile progressing over its circumference. In the case of axial thread rolling heads, as applicable according to the invention, the thread rolls have a profile formed from incline-free profile ribs, that is a rib profile. The distance between the ribs thereby corresponds with the incline of the thread to be formed on the workpiece. This is known per se. For example, three thread rolls can be provided, which are provided over the circumference of the insertion section respectively distributed spaced with respect to each other at 120°.

The axial thread rolling head according to the invention is designed in a non-opening manner. In particular, no actuation mechanism is provided, which moves the thread rolls outward in the radial direction after the forming of the external thread on the workpiece. Rather, the thread rolls are non-adjustable in the radial direction; that is, they are arranged fixed in the axial thread rolling head. Thus, in the case of the axial thread rolling head, the cross-section of the insertion section of the axial thread rolling head is unchangeable except for an unavoidable deflection of the thread rolls in the course of processing.

According to the invention, an unavoidable deflection of the thread rolls in the course of the processing is taken into account and compensated for in that the thread rolls have a suitable asymmetrical profile or respectively rib profile. In the case of the asymmetrical profile according to the invention, opposite lying profile flanks are thus respectively not mirror-symmetrical, in particular with respect to a line running in the radial direction through the bottom or respectively the deepest point between the profile flanks, at least via a processing section of the thread rolls engaging in a forming manner with the workpiece in the course of the processing. The asymmetrical profile according to the invention is thereby adjusted so that it forms a symmetrical thread profile on the workpiece taking into consideration the deflection of the thread rolls to be expected for the respective material and cross-section of the workpiece to be processed on one hand and the constructive conditions of the axial thread rolling head, in particular its dimensions, on the other hand.

Through the design of the axial thread rolling head according to the invention, it is possible to also process in a transformative and precise manner workpieces with a proportionately large cross-section using an axial thread rolling head with a proportionally small outer contour. Compared to the state of the art, the required space is reduced since the axial thread rolling head is non-opening. No complex and space-consuming actuating mechanism is needed to move the thread rolls outward in the radial direction. It is simultaneously ensured through the asymmetrical design of the profile of the thread rolls that the thread designed on the workpiece is precisely symmetrical. The desired external threads are thus produced reliably and precisely.

It is ensured through suitable selection of the design boundary conditions of the axial thread rolling head, in particular for example materials and material strengths, that the requirements with respect to function, stability and durability are safely met. In particular, the durability of the axial thread rolling head and its thread rolls can be ensured through the selection of a suitable material and a corresponding heat treatment.

According to the invention, a forming processing of the external thread of the workpiece can take place through the asymmetrical profile of the thread rolls both during insertion of the workpiece into the insertion section as well as during removal of the workpiece from the insertion section. The profile of the external thread to be produced is thus first designed completely through an insertion into and a removal of the workpiece from the insertion section. In particular, another deformation takes place through the asymmetrical profile of the profile rolls also during removal of the workpiece. Please note that, in this context, an insertion or a removal of the workpiece in or out of the insertion section does not necessarily mean that the workpiece must be moved in the axial direction. The insertion or respectively removal refers rather to a relative movement between the workpiece and the axial thread rolling head in the course of which the workpiece is inserted into the insertion section or respectively removed from the insertion section of the axial thread rolling head. In order to bring about this relative movement, a movement of the axial thread rolling head or also of the workpiece is possible. A movement of both the axial thread rolling head and the workpiece is also possible.

According to a further embodiment, the profile of the thread rolls can form respectively a pointed profile with straight flanks. The profile flanks lie respectively in a straight plane, wherein the planes of the respectively opposite-lying profile flanks lie at an angle to each other. In the case of a pointed profile, the angle formed between two opposite-lying profile flanks is less than 90°. On their summit, neighboring profile flanks can merge in a rounded head area. Accordingly, opposite-lying profile flanks can merge in an also rounded bottom area.

According to a further embodiment, it can be provided that a leading flank angle of the profile of the thread rolls lies respectively in an area between 28.0° and 30.0°, and is preferably 29.5°. A trailing flank angle of the profile of the thread rolls can then lie respectively in an area between 30.0° and 32.0° and can be preferably 31.0°. In this context, a leading flank angle is the angle between the profile flanks leading during insertion of the workpiece into the insertion section and a radial running through the bottom or respectively deepest point between opposite-lying profile flanks. Accordingly, a trailing flank angle is the angle between the trailing profile flanks lying opposite the leading profile flanks during insertion of the workpiece into the insertion section and a radial running through the bottom or respectively deepest point between opposite-lying profile flanks. According to the invention, the leading flank angle and the trailing flank angle are different so that the profile has the asymmetry explained above. If the opposite-lying profile flanks, that is leading and trailing profile flanks, do not lie in a respectively straight plane, but rather have e.g. a curvature, the angles can be designed respectively e.g. between a tangent placed at half the height on the curved profile flanks and the respective radial. Through the named angle areas, a deflection of the thread rolls is taken into consideration and a particularly high dimensional accuracy of the produced asymmetrical external thread is achieved. The described angle ratios can be available for the entire profile e.g. except for a start and an end area of the profile.

A ratio between the diameter of the cylindrical section and the thread spacing of the profiles of the thread rolls is also important for the stability of the system. The thread spacing is the distance between the middle of two neighboring thread pitch sections in the direction of the thread roll longitudinal axis. In the case of single-start threads, as are in particular affected according to the invention, the thread spacing corresponds with the thread pitch, i.e. the section in the direction of the thread roll longitudinal axis, around which e.g. a screw nut would be moved by 360° on the thread in the case of a full revolution. The larger the thread spacing or respectively the thread pitch, the greater are the radial forces occurring in the case of an axial thread rolling head during operation. Thus, the thread spacing or respectively the thread pitch must not be too large specifically in the case of small axial thread rolling heads, which have in particular a small diameter and thus also generally a small wall thickness. A ratio between the diameter of the thread rolls and the diameter of the workpiece to be processed can be respectively less than 1.4. A ratio between the diameter of the at least partially cylindrical section of the head part and the diameter of the workpiece to be processed can also be less than 3.8. The head part can be made of several sections. The head part can also have several cylindrical sections. The at least partially cylindrical section referenced in the aforementioned embodiments is the section mounting the thread rolls, which has the largest cross-section or respectively diameter.

According to a particularly practical embodiment, which also enables a particularly simple production, the head part can comprise a base section and a head plate fastened on the base section. The head plate ensures additional stability of the axial thread rolling head and reduces a deflection of the thread rolls. The thread rolls can be rotatably mounted in the base section and/or the head plate and can be held non-adjustably in the radial direction. The base section can be designed as one piece. It can comprise in particular one or more cylindrical sections of the head part. In the case of the non-opening axial thread rolling head according to the invention, the one-piece design of the head part leads to a particularly high stability and loading capacity during operation. According to a further embodiment, the thread rolls can be fixed respectively between a stop surface of the base section and a stop surface of the head plate in the axial direction.

The thread rolls can also be rotatably mounted on axial pins held in the base section. These are hereby also particularly practical embodiments. For the thread rolls, corresponding receivers can be provided in the base section and in the head plate. In a further embodiment, it can be provided that the longitudinal axes of the axial pins are tilted into the insertion section with respect to the insertion direction of the workpiece such that the insertion section tapers in the insertion direction of the workpiece. The processing is hereby simplified and a deflection of the thread rolls is already compensated for to a certain extent. It can also be provided that the head plate is screwed together with the base section by means of several fitting screws.

According to a further embodiment, it can be provided that the thread rolls in the longitudinal direction of the thread rolls arranged behind each other have respectively a first asymmetrical profile section and a second asymmetrical profile section for forming respectively an external thread on a workpiece, wherein the thread rolls can be respectively selectively aligned with the first profile section or the second profile section to the entrance of the insertion section in order to form an external thread selectively with the first profile section or the second profile section on the workpiece. In the case of this embodiment, the profiles are designed in duplicate on each thread roll, and namely in the opposite direction starting from the two front sides of the thread rolls or respectively starting from the middle of the thread rolls. Depending on the direction in which the thread rolls are inserted into the head part, the first or the second profile section can then be used for the thread formation on the workpiece. The length of the thread rolls is thereby designed such that a complete molding of the thread to be produced on the workpiece is possible without the rear one of the two profile sections seen in the insertion direction of the workpiece engaging with the workpiece. Furthermore, the first profile section and the second profile section can be respectively mirror-symmetrical to an axis extending perpendicular to the longitudinal axis of the respective thread roll. However, it is also conceivable that the first profile section and the second profile section are respectively not mirror-symmetrical to an axis extending perpendicular to the longitudinal axis of the respective thread roll, i. e. are designed differently. A greater flexibility is hereby achieved during the processing since the two profile sections can be adjusted for the processing of different workpieces.

The invention also relates to a method for forming an external thread on a workpiece with an axial thread rolling head according to the invention, in which the workpiece is inserted into the insertion section of the axial thread rolling head through a relative movement between the workpiece and the axial thread rolling head in the axial direction and is removed from it again, wherein a forming processing of the external thread of the workpiece takes place through the asymmetrical profile of the thread rolls both during insertion of the workpiece into the insertion section as well as during removal of the workpiece out of the insertion section. As already initially explained, it is possible to also form external threads on workpieces made of high-strength materials with the axial thread rolling head according to the invention. For example, the workpieces processed according to the invention can have tensile strengths of more than 600 $N/mm^2$, preferably more than 900 $N/mm^2$, even more preferably more than 1000 $N/mm^2$. As also initially explained, in particular the production of external threads on cylindrical appendages of fuel injection rails of an automobile is possible according to the invention.

BRIEF DESCRIPTION OF THE SEVERAL VIEWS OF THE DRAWING(S)

Figure 2:
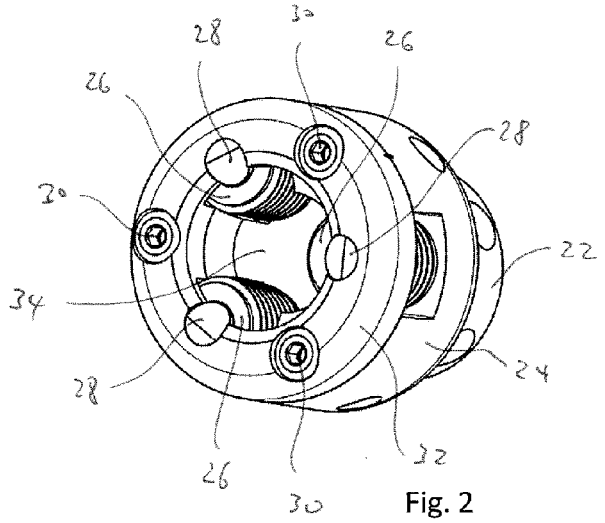
Figure 3:
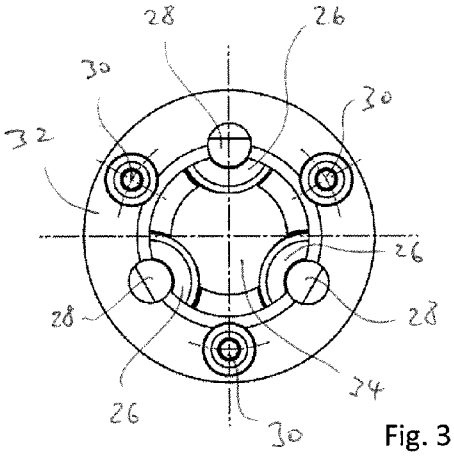
Figure 4:
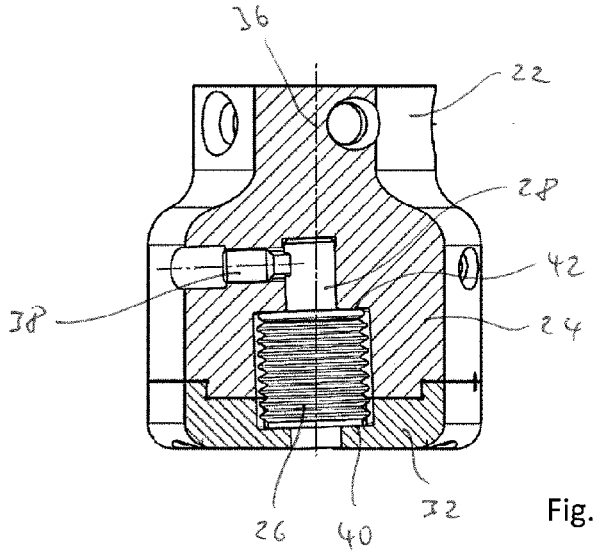
Figure 5:
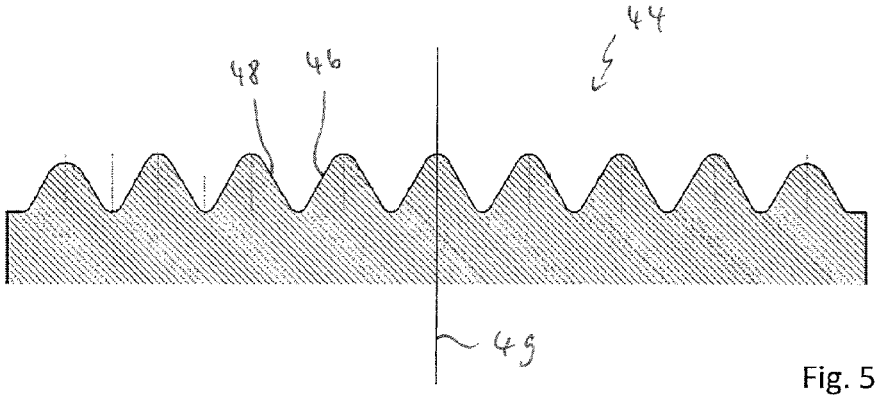
Figure 6:
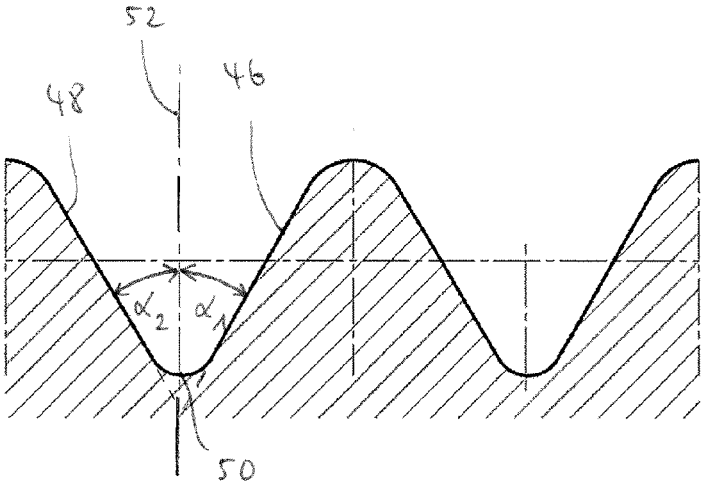
Figure 7:
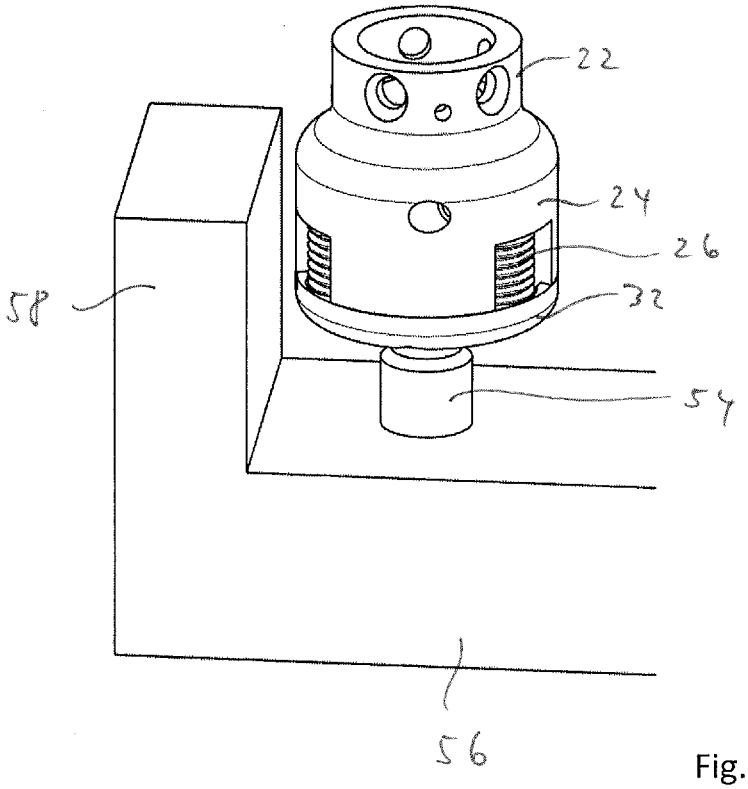

One exemplary embodiment of the invention is explained below in greater detail using figures. The drawing shows schematically in:

FIG. 1 an axial thread rolling head according to the invention in a perspective view, FIG. 2 the head part of the axial thread rolling head shown in FIG. 1 in a perspective view, FIG. 3 the head part from FIG. 2 in a front view, FIG. 4 the head part from FIG. 2 in a cross-sectional view, FIG. 5 a profile of the thread rolls of the axial thread rolling head shown in FIG. 1 in a cross-sectional view, FIG. 6 an enlarged detail of the representation in FIG. 5 and FIG. 7 a part of the axial thread rolling head shown in FIG. 1 in a processing state.

DETAILED DESCRIPTION OF THE INVENTION

While this invention may be embodied in many different forms, there are described in detail herein a specific preferred embodiment of the invention. This description is an exemplification of the principles of the invention and is not intended to limit the invention to the particular embodiment illustrated.

If not otherwise specified, the same reference numbers indicate the same objects in the figures. The axial thread rolling head according to the invention shown in FIG. 1 comprises a shaft 10 and a head part 12 held by the shaft 10. The shaft 10 has a clamping section 14, which serves to clamp into a suitable machine tool. Please note that it is also conceivable that the head part 12 itself has a clamping section for clamping into a machine tool. In this case, no shaft 10 would be required. In the shown example, the shaft 10 also has an enlarged section 16 and a cylindrical bearing section 18. The head part 12 has a first cylindrical section 22, with which it is permanently connected via several fastening screws 20 with the bearing section 18 of the shaft 10. A second cylindrical section 24 connects to the first cylindrical section 22 of the head part 12, wherein the cylindrical sections 22, 24 are designed as one piece and together form a base section of the head part 12. The second cylindrical section 24 has a greater diameter than the first cylindrical section 22. In the head part 12, three thread rolls 26 are rotatably mounted around their longitudinal axis in the shown example. In the shown example, the three thread rolls 26 are arranged evenly distributed along a circular path, respectively at a distance of 120°. The thread rolls 26 are rotatably mounted respectively on axial pins 28 held in the second cylindrical section 24.

The base section of the head part 12 formed by the cylindrical sections 22 and 24 is locked by a head plate 32 fastened on the second cylindrical section 24 by means of fitting screws 30. As can be seen for example in FIGS. 2 and 3, the thread rolls 26 amongst themselves border an insertion section 34 for a for example cylindrical workpiece to be processed with the axial thread rolling head.

It can be seen in FIG. 4 that the longitudinal axes of the axial pins 28, which can be hard metal axial pins for example, are tilted with respect to the insertion direction of the workpiece into the insertion section 34, which simultaneously corresponds with the longitudinal axis of the axial thread rolling head shown in FIG. 4 with reference number 36. The tilt is such that the insertion section 34 tapers in the insertion direction of the workpiece. The tilt angle of the axial pins 28 and thus the longitudinal axes of the thread rolls 26 with respect to the longitudinal axis 36 of the head part 12 can correspond with the gradient angle of the thread to be rolled. It can also be seen in FIG. 4 that the axial pins 28 are respectively fixed in their position by a threaded pin 38 pushing into a suitable clamping surface of the axial pins 28 in the radial direction. Thus, they can neither shift in the axial direction nor can they twist on their own axis. Finally, it can be seen in FIG. 4 that the thread rolls 26 are fixed in the axial direction between a stop surface 40 of the head plate 32 and a stop surface 42 of the second cylindrical section 24 of the base section. In particular, the second cylindrical section of the base section 24 and the head plate 32 have corresponding recesses for receiving the thread rolls 26.

The axial thread rolling head according to the invention shown in the figures is designed in a non-opening manner. In particular, the thread rolls 26 are held non-adjustably in the radial direction in the head part 12 via the axial pins 28. No actuation mechanism is provided, with which the thread rolls 26 can be displaced outward in the radial direction. The thread rolls 26 have respectively a profile running over its circumference, in particular an incline-free rib profile. This profile is shown in FIG. 5 in cross-section exemplary for one of the thread rolls 26. In the shown example, the profile 44 forms a pointed profile with straight profile flanks 46, 48. In particular, the profile flanks 46, 48 lie respectively in straight planes, which are arranged at an angle to each other, which is less than 90°. In the shown example, the thread rolls have in the longitudinal direction of the thread rolls a first asymmetrical profile section and a second asymmetrical profile section respectively arranged behind each other for each forming one external thread on a workpiece. The first profile section extends in the example shown in FIG. 5 left of the center axis shown with reference number 49. The two asymmetrical profile sections are designed mirror-symmetrical to the center axis 49.

FIG. 6 shows an enlarged sectional representation of the profile section shown in FIG. 5 left of the center axis 49. Reference number 46 shows a leading profile flank of the profile 44 in the course of the insertion of a workpiece into the insertion section. Reference number 48 shows a trailing profile flank lying opposite the leading flank 46 in the course of the insertion of a workpiece into the insertion section. A leading flank angle $\alpha_1$ between the leading profile flank 46 and a radial 52 running through the bottom or respectively deepest point 50 between the leading profile flank 46 and the opposite-lying trailing profile flank 48 to the cylindrical thread roll 26 lies in the example shown in an area between 28.0° and 30.0° and is preferably 29.5°. A trailing flank angle $\alpha_2$ between the trailing profile flank 48 and the radial 52 lies in the shown example in an area between 30.0° and 32.0° and is preferably 31.0°. It is understood that, in the case of the profile section not shown in FIG. 6 and shown in FIG. 5 right of the center axis 49, the leading profile flank and the trailing profile flank and thus the leading flank angle and the trailing flank angle are interchanged. The profile 44 of the profile rolls 26 is thus designed asymmetrically in particular with respect to the radial 52. Through this asymmetry, it is ensured also in the case of an unavoidable deflection of the thread rolls 26 in the course of the processing of high-strength materials with tensile strengths of e.g. more than 600 N/mm$^2$ that a specified symmetrical external thread is created in a precise manner on a workpiece in the course of the insertion of the cylindrical workpiece into the insertion section 34 and the removal of the cylindrical workpiece out of the insertion section 34.

In the case of the axial thread rolling head shown in the figures, a ratio between the largest diameter of the head part 12, in particular the diameter of the second cylindrical section 24, and the diameter of the workpiece to be processed is less than 3.8. Moreover, a ratio between the diameter of the thread rolls 26 and the diameter of the workpiece to be processed is respectively less than 1.4. The ratio between the diameter of the head part 12, in particular the diameter of the second cylindrical section 24, and the diameter of the thread spacing of the profiles of the thread rolls 26 is also important for the stability of the system. Thus, for example in the case of an outer diameter of the head part of 40 mm and a thread to be produced M14×1.5, the specified ratio would be 26.667 and thus a still sufficient stability of the system would be given.

Due to the small outer dimensions, it is also possible to process workpieces that only have a small working space available due to structural conditions. FIG. 7 shows an example, in which a cylindrical appendage 54 is provided with an external thread with the axial thread rolling head according to the invention, which is designed on a component 56. As can be seen in FIG. 7, the available working space is greatly restricted in particular by the end section 58 of the components 56.

The number of parts of the axial thread rolling head according to the invention is reduced with respect to conventional axial thread rolling heads due to the non-opening construction and the thus not required actuation mechanism. The embodiment of the axial thread rolling head according to the invention simultaneously enables, in addition to the compact construction, an always sufficient load capacity during operation. This also applies during the processing of workpieces with a comparatively large diameter. Since no option is provided for influencing the diameter of the rolled thread through a radial displacement of the thread rolls in the axial thread rolling head, thread rolls with another diameter may need to be installed in order to perform an adjustment for material change, machine conditions, customer wishes, etc.

The above disclosure is intended to be illustrative and not exhaustive. This description will suggest many variations and alternatives to one of ordinary skill in this art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

The invention claimed is:

1. An axial thread rolling head, comprising a head part (12), in which at least three thread rolls (26) are rotatably mounted, wherein the thread rolls (26) amongst themselves border an insertion section (34) for a workpiece, and wherein the thread rolls (26) each have a profile (44) for forming an outer thread on the workpiece, characterized in that the thread rolls (26) are held non-adjustably in the radial direction in the head part (12), wherein the profile (44) of each thread roll (26) is respectively designed asymmetrically such that the thread rolls (26) with their asymmetrical profile form a symmetrical external thread on the workpiece, and further wherein the profile (44) of each thread roll (26) includes a leading flank angle ($\alpha$1) and a trailing flank angle ($\alpha$2) and wherein the leading flank angle ($\alpha$1) and the trailing flank angle ($\alpha$2) are not mirror symmetrical.

2. The axial thread rolling head according to claim 1, characterized in that a forming processing of the external thread of the workpiece takes place through the asymmetrical profile of the thread rolls (26) both during insertion of the workpiece into the insertion section (34) as well as during removal of the workpiece from the insertion section (34).

3. The axial thread rolling head according claim 1, characterized in that the profile (44) of the thread rolls (26) respectively forms a pointed profile with straight flanks (46, 48).

4. The axial thread rolling head according to claim 1, characterized in that the leading flank angle ($\alpha$1) of the profile (44) of the thread rolls (26) lies respectively in an area between 28.0° and 30.0° and in that the trailing flank angle ($\alpha$2) of the profile (44) of the thread rolls (26) lies respectively in an area between 30.0° and 32.0°.

5. The axial thread rolling head according to claim 1, characterized in that a ratio between a diameter of the thread rolls (26) and a diameter of the workpiece to be processed is respectively less than 1.4.

6. The axial thread rolling head according to claim 1, characterized in that the head part (12) has an at least partially cylindrical section (24), wherein a ratio between a diameter of the cylindrical section (24) and a diameter of the workpiece to be processed is less than 3.8.

7. The axial thread rolling head according to claim 1, characterized in that the head part (12) has a base section (22, 24) and in that the head part (12) has a head plate (32) fastened on the base section.

8. The axial thread rolling head according to claim 7, characterized in that the base section (22, 24) is designed as one piece.

9. The axial thread rolling head according to claim 7, characterized in that the thread rolls (26) are fixed respectively in the axial direction between a stop surface (42) of the base section (22, 24) and a stop surface (40) of the head plate (32).

10. The axial thread rolling head according to claim 7, characterized in that the thread rolls (26) are rotatably mounted on axial pins (28) held in the base section.

11. The axial thread rolling head according to claim 10, characterized in that a longitudinal axes of the axial pins (28) are tilted with respect to the insertion direction of the workpiece into the insertion section (34), such that an insertion section (34) tapers in the insertion direction of the workpiece.

12. The axial thread rolling head according to claim 7, characterized in that the head plate (32) is screwed together with the base section by means of several fitting screws (30).

13. The axial thread rolling head according to claim 1, characterized in that the thread rolls (26) in a longitudinal direction of the thread rolls (26) have the profile (44) wherein respectively a first asymmetrical profile section and a second asymmetrical profile section for each forming one external thread on a workpiece are arranged behind each other, wherein the thread rolls (26) can be respectively selectively aligned with the first profile section or the second profile section to the entrance of the insertion section (34) in order to form an external thread selectively with the first profile section or the second profile section on the workpiece.

14. The axial thread rolling head according to claim 13, characterized in that the first profile section and the second profile section are respectively mirror-symmetrical to an axis (49) running perpendicular to the longitudinal axis of the respective thread roll (26).

15. The axial thread rolling head according to claim 1, characterized in that only one asymmetrical profile section is provided on the respective thread roll (26).

16. A method for forming an external thread on a workpiece with an axial thread rolling head , comprising the steps of:

providing the axial thread rolling head of claim 1;

inserting the workpiece into the insertion section (34) of the axial thread rolling head through a relative movement between the workpiece and the axial thread rolling head in a axial direction and is removed from it again, and forming the external thread of the workpiece takes place through the asymmetrical profile of the thread rolls (26) both during insertion of the workpiece into the insertion section (34) as well as during removal of the workpiece out of the insertion section (34).

17. The method according to claim 16, characterized in that the workpiece has a tensile strength of more than 600 N/mm2.

* * * * *